United States Patent [19]

Taguchi et al.

[11] 4,129,437

[45] Dec. 12, 1978

[54] IRON ORE PELLET HAVING A SPECIFIC SHAPE AND A METHOD OF MAKING THE SAME

[75] Inventors: Kazumasa Taguchi, Amagasaki; Tsutomu Nishida, Kobe; Masaharu Kitajima, Okayama; Kan Aketa, Kakogawa; Isao Fujita, Kobe; Mamoru Onoda, Miki; Nobuyuki Imanishi; Ryo Watanabe, both of Kobe, all of Japan

[73] Assignee: Kobe Steel, Ltd., Kobe, Japan

[21] Appl. No.: 690,289

[22] Filed: May 26, 1976

[30] Foreign Application Priority Data

May 26, 1975 [JP] Japan ..... 50/63317
May 26, 1975 [JP] Japan ..... 50/63318

[51] Int. Cl.[2] ..... C21B 1/10

[52] U.S. Cl. ..... 75/5; 75/41; 75/257

[58] Field of Search ..... 75/42, 43, 44 R, 3, 75/4, 5, 7, 9, 11, 41.5, 257

[56] References Cited

U.S. PATENT DOCUMENTS

| | | | |
|---|---|---|---|
| 3,012,970 | 12/1961 | Banks et al. | 75/42 |
| 3,383,199 | 5/1968 | Schmidt | 75/4 |
| 3,938,987 | 2/1976 | Ban | 75/3 |
| 3,948,612 | 4/1976 | Schulten-Baumer | 75/44 |
| 3,966,457 | 6/1976 | Limpach | 75/42 |
| 3,969,103 | 7/1976 | Capes et al. | 75/3 |
| 3,980,465 | 9/1976 | Nishida et al. | 75/3 |
| 3,986,864 | 10/1976 | Hofmann et al. | 75/3 |

OTHER PUBLICATIONS

McGannon; *Making, Shaping and Treating of Steel*; New York (USS) 1964 p. 188.

Webster, *New International Dictionary* (unabridged) New York, 1961 p. 203.

*Primary Examiner*—M. J. Andrews

*Attorney, Agent, or Firm*—Oblon, Fisher, Spivak, McClelland & Maier

[57] ABSTRACT

In the present invention, after a powdered iron ore has been subjected to granulation and firing into spherical pellets, a further crushing is applied while adjustment of the particle size of the crushed pellets is made so that the outer surface of the pellets is composed of spherically formed surfaces and crushed surfaces. By doing so, improvements are made in the angle of repose and in the reducing characteristic of iron ore pellets, and eventually an efficient and highly economical blast furnace operation is attained.

9 Claims, 17 Drawing Figures

IRON ORE PELLET HAVING A SPECIFIC SHAPE AND A METHOD OF MAKING THE SAME

BACKGROUND OF THE INVENTION

1. Field of the Invention

The present invention relates generally to blast furnaces and more particularly to a specifically configured iron ore pellet to be used as the raw material in the blast furnace, a method of making such pellets, and a method of operating the blast furnace using such pellets.

2. Description of the Prior Art

In recent years, the ore beneficiation technique in the iron ore industry has made remarkable progress, so that powdered ores produced in mines, which had usually been discarded, are now positively utilized as the raw material for iron to be charged into blast furnaces as lump ores. Thus their value as goods has been improved to a remarkable extent. As is publicly known, the sintering method and the pelletizing method are the two principal methods for such ore beneficiation, as reflected by the high percentage of approximately 80%, which is the ratio of ores beneficiated by the two methods relative to the total amount of raw materials charged into blast furnaces in Japan. Of these beneficiated ores, the amount of production of sintered ores is over-whelmingly high, but recently that of pellets is increasing with respect to both import and domestic production, that is, it accounts for nearly 20% of beneficiated ores. In addition, there has already been established a mass production system for the so-called self-fluxed pellet which has been pre-adjusted into slag component for a more efficient operation of the blast furnace. Conventional plants can with a daily output of 8,000 tons, and thus, in some plants, a blast furnace operation with an increased blend ratio of pellets is greatly facilitated.

However, the operation of a blast furnace charged with a considerable amount of pellets does not always render favorable results as compared with the case in which a considerable amount of sintered ores are blended. Pellets possess some properties which are more advantageous than sintered ore in some aspects, but when viewed as a whole, it also has such drawbacks as are not fully satisfactory.

In particular, the drawbacks associated with conventional pellets are attributable to the physical property that they are in the form of a sphere, and this deleteriously affects the operation of the blast furnace.

Detailed reasons for the above are set out below while reference is made to FIGS. 1 and 2. When pellets are used in a blast furnace operation, pre-weighed spherical pellets of diameters ranging from 5 to 20 mm, and coke as a reducing agent, are charged in an alternate manner into a blast furnace (1) through its charging portion (2) as illustrated in FIG. 1, so that inside the furnace, a pellet layer (PL) and a coke layer (CL) are piled one upon another, that is, in a layer-by-layer manner. As a result, layers piled at the upper portion within the furnace each generally form a depression at the central portion thereof and a raised portion at the periphery, thus giving rise to a V type distribution. In this case, it is desired that the pellet layers (PL) and coke layers (CL) be uniformly piled with little change in layer thickness in the radial direction within the furnace. Actually, however, this is not realized because the coke and the pellets are markedly different in their physical properties. That is, as shown in FIG. 2, when the pellets (p) are charged into a coke layer (CL) in the furnace, there will be a larger amount of pellets flowing from the periphery toward the central portion as compared with the case of coke (C), resulting in the fact that the pellet layer (PL) formed within the furnace will have a remarkably larger layer thickness ($t_1$) at its central portion than the layer thickness ($t_2$) at its peripheral portion, thus causing non-uniformity in the radial direction. Furthermore, when coke is charged onto such pellet layer (PL), there will be a smaller amount of coke flowing toward the central portion than that of the pellets because the angle of repose as measured from the longitudinal axis of the furnace is larger for the coke layer than that of the pellets with the result that the coke layer (CL) formed within the furnace will have a remarkably smaller layer thickness $(t_1)'$ at its central portion than the layer thickness $(t_2)'$ at its peripheral portion contrary to the case of the pellet charging, thus also causing a non-uniform layer thickness distribution in the radial direction. When this is repeated, the inside of the furnace as a whole will be in such condition as that shown in FIG. 2, that is, there occurs a non-uniform distribution such that the pellets are accumulated in the central portion and the coke is accumulated at the periphery, so that the flowing velocity of the gas from below becomes higher at the peripheral portion and lower at the central portion as schematically indicated by the upward arrows in FIG. 2. Consequently, the temperature of the peripheral portion in the furnace becomes higher than that of the central portion, with the amount of reducing gas produced being larger at the periphery and the reduction reaction of the raw iron material being increased at the peripheral portion.

The amount of charged material flowing toward the central part of the furnace depends greatly upon the so-called angle of repose of that charged material. Table 1 shows the angle of the repose of materials charged and the angle of inclination within the furnace. As shown, the angle of repose of the pellets has small values as compared with that of coke, and this difference causes the foregoing non-uniform phenomenon to occur in the furnace. On the other hand, the values of sintered ore are substantially in the same range as those of coke, so that in the case of sintered ore, the foregoing phenomenon does not normally occur and a uniform distribution of layer thickness is obtained relatively easily. The reason why pellets cause such non-uniform phenomenon to occur is that pellets are spherical and are almost perfectly round, and have a smooth surface and therefore its contact frictional resistance is extremely lower when compared with that of sintered ore and coke that structures of which are quite non-uniform or uneven.

Table 1

| Material charged | Angle of repose | Angle of inclination in furnace |
|---|---|---|
| Pellet | 25–28 | 20–26 |
| Sintered ore | 31–34 | 29–31 |
| Coke | 30–35 | 33–38 |

As set forth hereinbefore, the flowing of conventional pellets toward the central part of the furnace, and the resulting non-uniform distribution of the layer thickness causes the coke layers to become disordered and the flow of reducing gas to be biased toward the peripheral portion or to become non-uniform and unstable, and there also occurs a disordered furnace condition such as an unbalanced descent in the furnace of the materials being charged, resulting in the reduction reaction in the furnace being impeded and the operational efficiency thereof being lowered. Furthermore, even after being piled in the furnace, the pellets will normally undergo vibration or irregular movement due to the flow of gas therethrough, and consequently will be incorporated into the adjacent coke layer, thus causing the thickness of the coke layer to become non-uniform and the permeability of the furnace to be varied and the reactivity of coke deleteriously affected. To be more specific, it becomes impossible to increase the ore/coke ratio which results in decreased productivity and increased coke consumption.

It is known that the reduction reaction of the pellets proceeds topochemically from the periphery towards the center, but within a high temperature portion, there is formed at the periphery a close and hard metallic iron layer which is the reduction product, which impedes the invasion of the reducing gas to the pellet interior so that an unreacted nucleus is liable to remain at the interior of the pellet. Such a drawback is also attributable to the spherical shape of the pellet. The residual unreacted portion causes a lowering in the softening and melting points of the pellet and also may cause a phenomenon of fusion between pellets. Due to the spherical shape of the pellets, moreover, the condition in the furnace approaches that of close charging, in which condition there are only a small number of spaces within the pellet layer, whereby such phenomenon of fusion is further promoted. It goes without saying that such fusion in the pellet layer results in poor permeability of the reducing gas and an efficient operation of the blast furnace is rendered difficult.

SUMMARY OF THE INVENTION

The present invention has been accomplished for eliminating the foregoing drawbacks associated with conventional spherical pellets, and it is the first object of the invention to provide an iron ore pellet having a large angle of repose and an excellent reducing characteristic, and a method of producing the same.

The second object of the invention is to provide an iron ore pellet whereby the layer thickness distribution in the furnace of the iron ore pellets and coke which are materials charged into the blast furnaces can be uniformalized and the ore/pellet ratio can be improved, thereby contributing to an increase in the amount of pig iron produced, and a method of producing the same.

The third object of the invention is to provide an ideal method of operating a blast furnace, which method is highly efficient and extremely stable.

The first embodiment of the invention which attains the above-mentioned objects comprises an iron ore pellet, such as an oxidized pellet, and a reduced pellet whose external form is composed of a combination of spherically formed surface(2) and crushed surface(s).

The second embodiment of the invention comprises a method of making the iron ore pellet of the first embodiment characterized in that a powdered iron ore, as the starting material, is subjected to granulation and firing or aging into spherical pellets, and subsequently, the pellets are crushed while adjustment in the particle size of the crushed pellets is made so as to give an average particle size in the range of from 5 to 25 mm.

The third embodiment of the invention comprises a method of operating a blast furnace characterized in that iron ore pellets of the first embodiment whose external forms are each composed of a combination of spherically formed surface(s) and crushed surface(s) are charged into the blast furnace for the operation thereof.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views and wherein.

DETAILED DESCRIPTION OF THE ILLUSTRATED EMBODIMENTS

Figure 1:
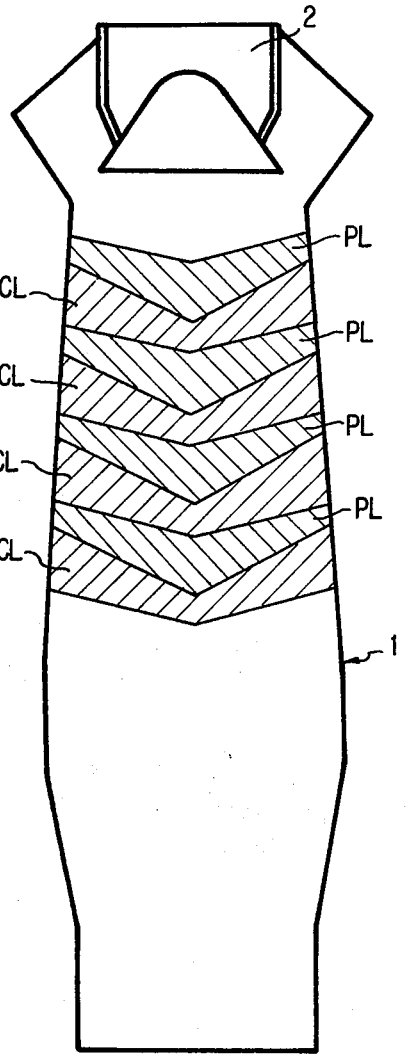
FIG. 1 is a schematic longitudinal sectional view of a blast furnace showing the distribution condition in a furnace of pellets and coke which have been introduced into the furnace as materials to be charged.
Figure 3:
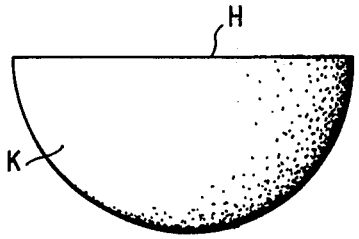
FIGS. 3 through 5 are front elevation views showing typical embodiments of the pellet of the invention.
Figure 4:
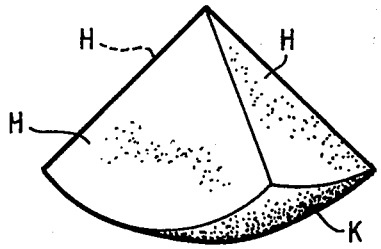
Figure 5:
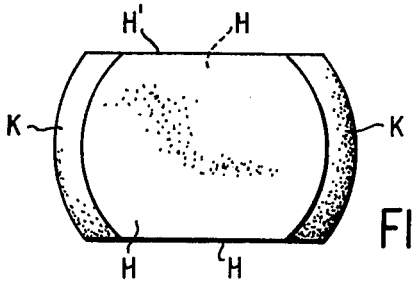
Figure 2:
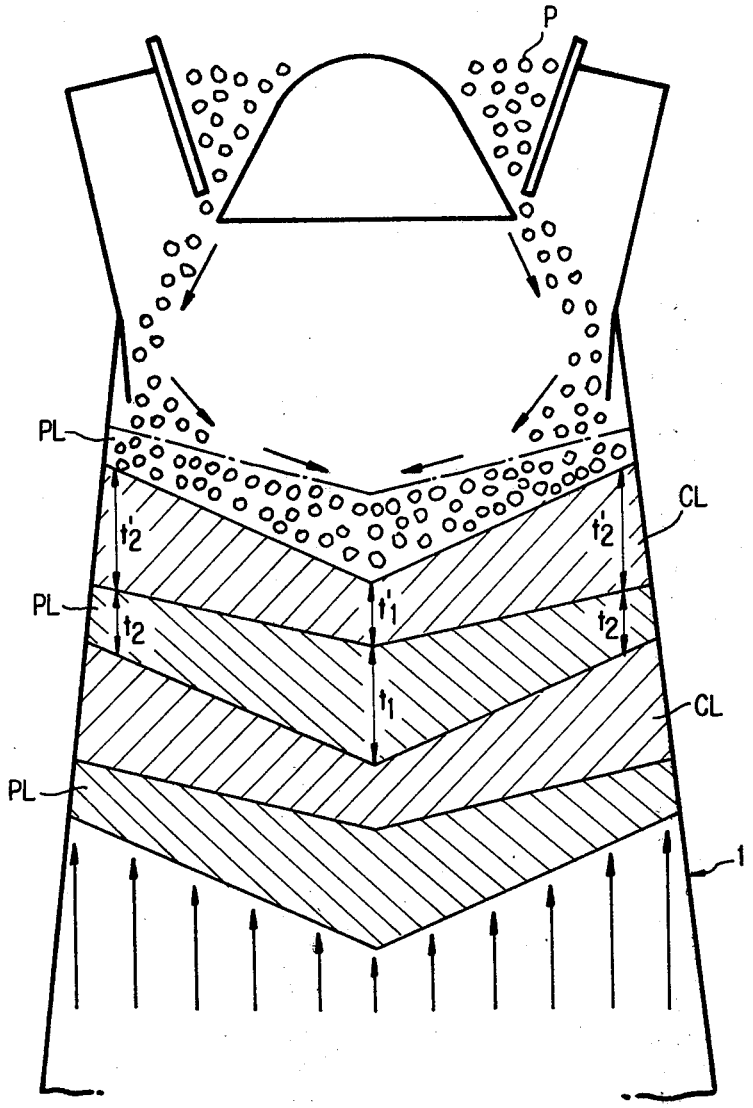
FIG. 2 is a schematic longitudinal sectional view of the charging portion of the blast furnace illustrating the flowing characteristics of the charged pellets.

As seen in FIGS. 3 through 5, which show typical types of pellets of the present invention, the external form of the pellet of the invention is composed of a combination of projecting, spherically formed surface(s) (K) and crushed surface(s) (H). The embodiment of FIG. 3 is the simplest example in which a sphere has been crushed and cut into halves, with the number of formed surfaces (K) and that of crushed surfaces (H) each being one. FIG. 4 shows an embodiment in which a sphere has been crushed into eight equal parts with the number of formed surfaces (K) being one and that of crushed surfaces (H) being three. The embodiment of FIG. 5 has been obtained by removing equal amounts of the top and bottom, and front and rear portions of a sphere through crushing, whose outer form is composed of two formed surfaces (K), one on the right and the other on the left, and four crushed surfaces (H).

Each one of the "spherically formed surfaces (K)" corresponds to the outer surface of conventional pellets, that is, it is a surface formed by the conventional method of preparing pellets involving granulation, firing or the like, the surface being relatively smooth. On the other hand, the "crushed surface (H)" is a surface newly produced separately from the formed surface when a spherical pellet has been crushed and divided by means of a physical shock or a chemical effect, and is quite uneven and rough.

Figure 9A:
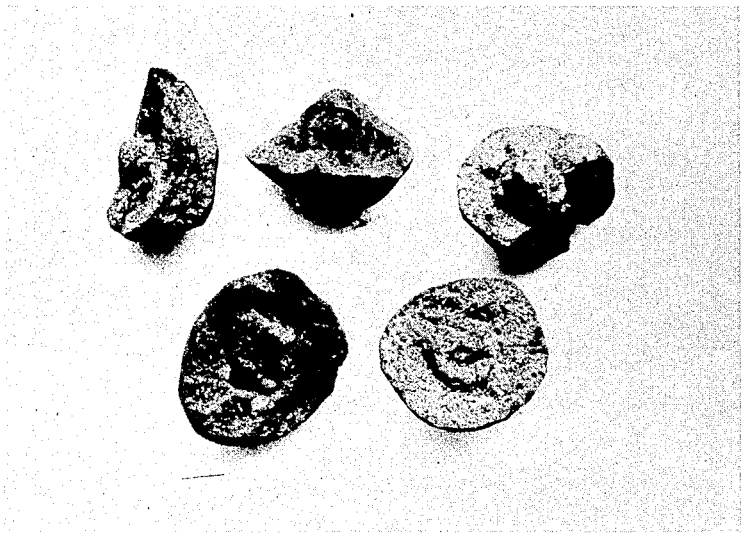
FIGS. 9A and 9B are photographs showing the external forms of the pellets of the invention.
Figure 9B:
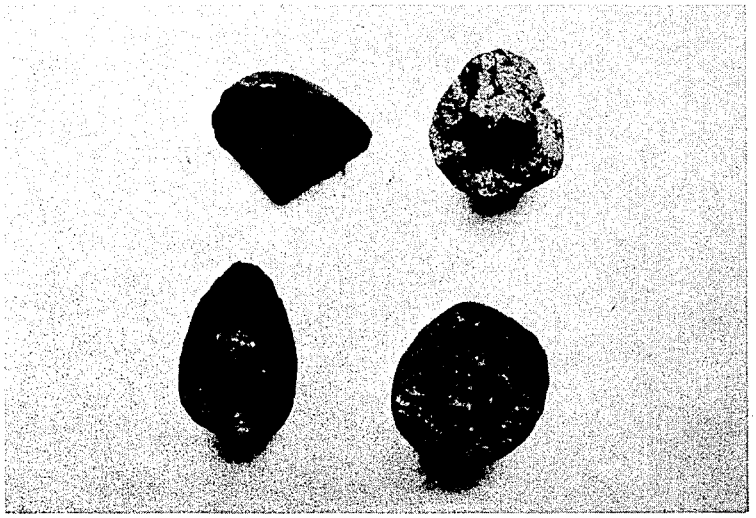

FIGS. 3 through 5 are examples of extremely simple external forms which have been shown for the purpose of giving an easier understanding of the concept of the external form of the pellet of the present invention. In these examples, the number of combinations between the formed surfaces (K) and the crushed surfaces (H) is small. However, it goes without saying that the present invention is not limited to such examples, and many surfaces may be combined; in particular, pellets of the present invention with a somewhat larger number of crushed surfaces are considered to be rather preferable. FIGS. 9A and 9B are photographs showing the external form of an actual crushed pellet.

This pellet has been prepared by making a pellet of a large particle size of about 40 mm by a conventional method, subjecting the pellet to firing, and crushing the resulting spherical pellet so that its particle size is about 15 mm. As is apparent from the same photograph, the crushed pellet has new crushed surfaces which are quite uneven and rough, so that it possesses a unique property such that the contact frictional resistance and surface area of the pellet are remarkably increased as compared with conventional spherical pellets.

Figure 6:
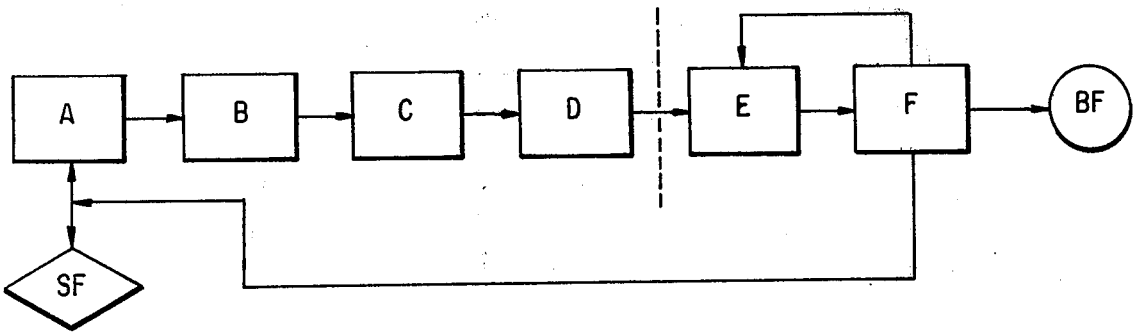
FIG. 6 is a flow chart illustrating a method of making the pellet of the invention.

With respect to the present invention, the following description is now provided mainly with respect to the method of making the pellet of the invention. FIG. 6 is a flow chart illustrating the process of the method according to the present invention. First, in the step for adjusting the parameters for the raw material (A), adjustment is made to the pellet material by well-known means, that is, grinding of the ore material, adjustment of the particle size and adjustment of the components and of the moisture content, or the like, are performed. Grinding is accomplished using a suitable crusher such as a ball mill so as to give a particle size range of 60–95% below 44$\mu$ and 15–25% below 10$\mu$. After grinding, a slag component such as lime is incorporated into the raw material, if required, and also, bentonite as a binder is added in an amount of about 0.5%, and further, 8 to 10% of water is blended for adjustment of the moisture content.

The pellet material after adjustment is conveyed to the following granulating step (B), where it is granulated into a spherical, so-called green pellet. A preferred type of this granulation step is different from the conventional one. Green pellets of large particle sizes ranging from 30 to 50 mm are prepared by means of a granulating machine such as a pan pelletizer and a drum pelletizer. Even with pellets of conventional particle sizes ranging from 10 to 20 mm, the objects of the present invention can be attained, but the quality and value of the final product are lowered as compared with pellets of large particle sizes.

Green pellets after granulation are fed to the firing step (C), where the pellets are oxidized and fired so as to obtain a certain quality (compressive strength above 200 kg/pellet, drum index about 95% above 5 mm, swelling index below 14%). As the firing method, any of the shaft, grate, and grate kiln systems may be adopted. The firing temperature ranges from 1150° to 1400° C. As publicly known, firing must be preceded by a thorough drying and pre-heating. Fired pellets are air-cooled in the cooling step (D) to near ordinary temperature by means of an annular cooler or the like. With pellets of particle sizes ranging from 30 to 50 mm, the foregoing granulation, firing and cooling steps can be done without any special difficulty, and on a conventional plant scale a sufficient production and smooth operation can be ensured.

Figure 7:
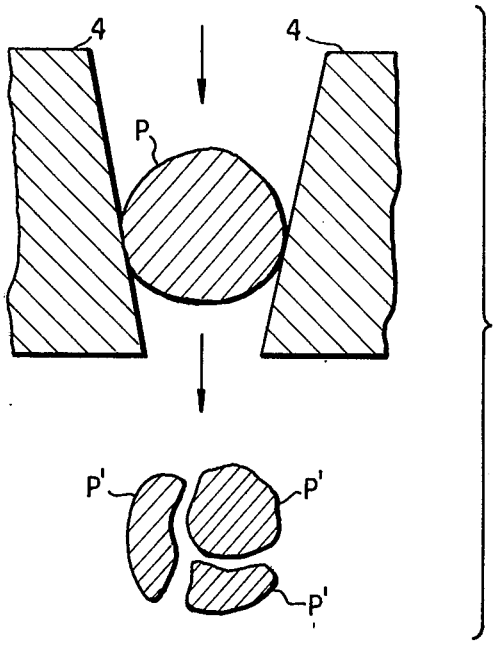
FIG. 7 is a schematic longitudinal sectional view of a crusher illustrating the crushing step of the method of FIG. 6.

Pellets are then conveyed to the crushing step (E) and product adjusting step (F). These steps constitute an extremely important feature in the method of producing the pellets of the present invention. Heretofore, pellets after cooling have been used as the iron raw material in a blast furnace. In the method of the present invention, however, the abovementioned steps have been newly incorporated, whereby a successful result was obtained in fundamentally improving the properties of conventional pellets which have such drawbacks as have been referred to hereinabove. In the crushing step (E), as shown in FIG. 7, there is employed a crusher provided with a pair of opposed crusher paltes (4) which open and close and thus oscillate toward right and left when actuated by drive means (not shown). A spherical pellet (P) is introduced and dropped between the plates (4). In this case, design is made in advance so that, when dropping, the pellet passes, through the minimum gap between the plates, at least once, resulting in the fact that the pellet (P) is crushed by means of the shock with both plates and a plurality of crushed pellets (P)′ are newly produced. These crushed pellets, as set forth hereinbefore, correspond to the pellet of the present invention having an external form constructed by a complex combination of spherically formed surface(s) and crushed surface(s). Since this crusher can be easily scaled up with a simple apparatus or machinery, it is advantageous to employ, but conventionally-known various crushers, such as jaw crushers and hammer crushers, are also employable. It is preferable that the desired particle size of crushing be set so that the mean value of representative diameters of the resulting crushed pellets (P)′ is in the range of from about 5 to about 25 mm. With values below 5 mm, pellets when charged into the blast furnace are piled in a close manner resulting in poor permeability of the gas flow in the furnace, while with values above 25 mm, the reduction characteristic is not sufficiently improved.

In the product adjusting step (F), the crushed pellets are adjusted to the above-mentioned proper range of particle size by means of a classifier. That is, pellets whose particle sizes are beyond the upper limit are returned to the crushing step (E) where they are crushed together with pellets which have been conducted thereto immediately after cooling. On the other hand, pellets whose particle sizes do not reach the lower limit are returned to the raw material adjusting step (A) to be re-used as the raw material or they are utilized as the sintering raw material (SF). Those crushed pellets which have been adjusted to proper particle size through the product adjusting step (F) are finally conveyed to a blast furnace (BF) where they function as a part, or all, of the iron raw material.

In the aforementioned cooling step (D), it is also useful to employ in place of conventional slow cooling means, a quenching means by cooling water or forced air-cooling so that the crushing efficiency in the subsequent crushing step (E) may be improved. Also, it is even possible to omit the crushing step, depending on the quenching conditions.

The hereinbefore described method is a method of preparing the so-called oxidization pellet affording a strong hardened matter of $Fe_2O_3$ structure as the final product. However, the pellet of the present invention is also applicable to reduction or semi-reduction pellets of mainly Fe and FeO structures which are obtained by calcination under a reducing or neutral atmosphere. Consequently, its production method is also able to be accomplished by combining the crushing and the product adjusting steps with the production step for such reduced or semi-reduced pellets. Furthermore, the method of the present invention is applicable not only to pellets of the pure ores as the raw material, but also as a method of handling dust pellets and cold pellets.

The pellet of the present invention is characterized by the aforementioned external form. This limitation is made because there could be brought about a marked improvement in the angle of repose and in the reduction characteristic of the pellets, as will be referred to later, and also because, by making a spherically formed surface coexistent, basically, the desired pellet can be obtained by simply incorporating the crushing and the adjusting steps as they are into the conventional production process, as will be apparent from the above explanation concerning the production method.

Figure 8:
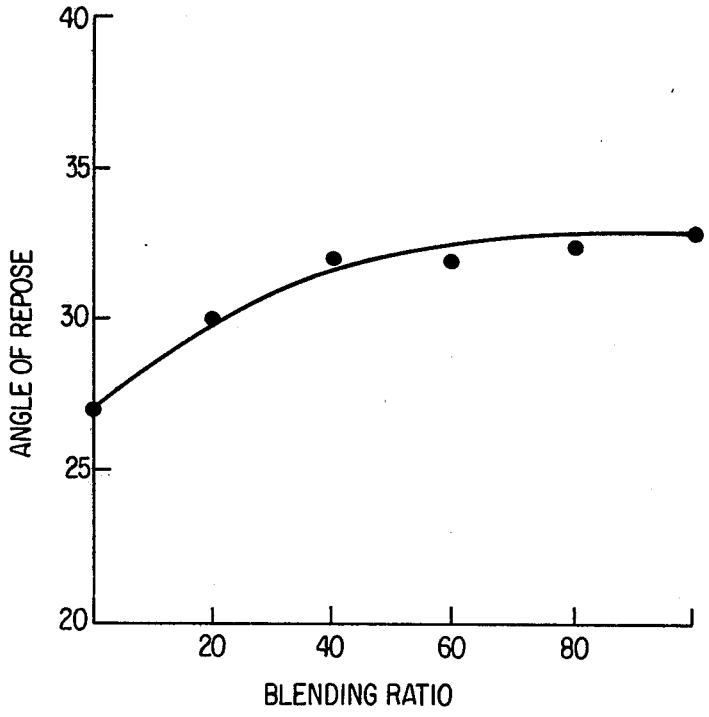
FIG. 8 is a graph showing the result of an experiment which has investigated the relation between the blending ratio and the angle of repose of the pellets of the invention when mixed with conventional pellets.

In order to clarify the excellent effects of the present invention, reference is made below to the results of experiments. FIG. 8 is a graph showing the relation between the blending ratio and the angle of repose in the case where crushed pellets are blended, which pellets have been prepared by crushing spherical pellets, each having a particle size of about 40 mm into pellets of about 15 mm. From this, it is seen that by blending only 40 with 60% of the pellets of the present invention to conventional pellets, a remarkable increase in the angle of repose is recognized. With the crushed pellets along (100%), the angle of repose is approximately 33° which is about the same level as that of the other charged materials, namely, sintered ore and coke. Generally speaking, the angle of repose of the crushed pellets is about 28° to 35°, although it differs according to the crushing method, and thus there is a great improvement in the properties of the furnace operation as compared with the same using conventional spherical pellets (angle of repose 25°–28°). From this experimental result, it has become clear that when this pellet is used for a blast furnace, it is not always necessary to use the entire amount thereof and that a sufficient improvement can be expected even when it is blended with conventional pellets with a suitable ratio. Furthermore, an increase in the contact resistance results in an improvement in the angle of repose, and an increased surface area leads to an increase in the area of contact with the reducing gas resulting in the fact that the property of undergoing reduction is improved; in addition, since the minimum distance to the center of the pellet becomes shortened, an unreacted nucleus is not readily formed, so that the phenomena of softening and fusion are suppressed. Thus the pellet of the present invention discloses improved properties.

Figure 10:
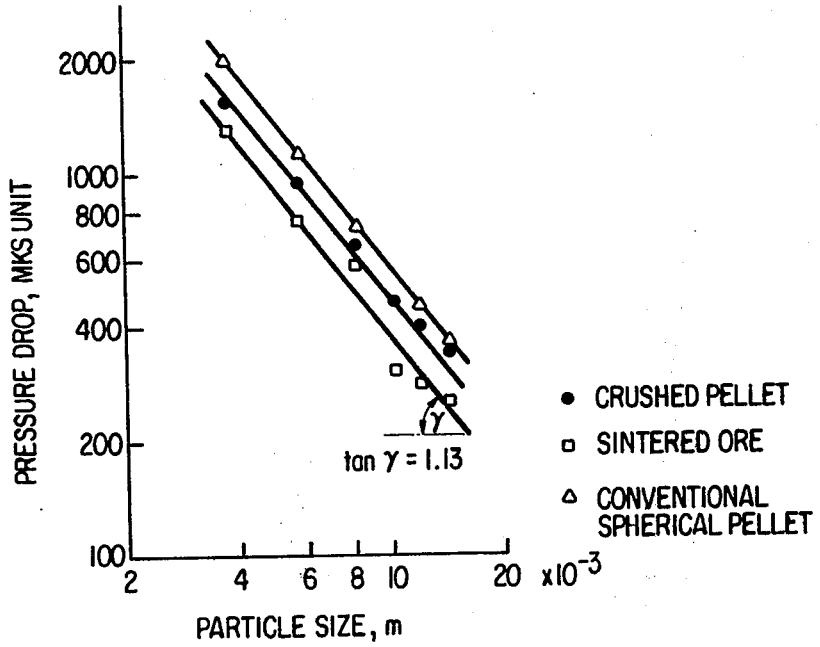
FIG. 10 is a graph showing the relation between particle size and pressure drop.

FIG. 10 shows the relation between permeability and the particle size, in ech case of a conventional spherical pellet, a sintered ore, and the crushed pellet of the present invention, in which the pressure drop was calculated by measuring the pressure drop caused when air is blown into the cylindrical vessels of an inner diameter of 150mm and a height of 1500mm, each of which is filled with the above-mentioned pellets, 200mm in height. Permeability is evaluated by determining the coefficient of the pressure drop from FIG. 10, which indicates the magnitude of the pressure drop, according to the following relation, $$K = \alpha D_P^{-1.13}$$

wherein K is the pressure drop, $D_P$ is the particle size, and $\alpha$ is the coefficient of the pressure drop, the results of which are shown in Table 2.

Table 2

| | Coefficient of the pressure drop |
|---|---|
| Conventional Spherical pellet | $10.5 \times 10^3$ |
| Sintered ore | $7.0 \times 10^3$ |
| Crushed pellet | $8.5 \times 10^3$ |

It is apparent from these data that the crushed pellet of the present invention exhibits excellent permeability as compared with conventional spherical pellets.

The use of the pellet of the present invention is advantageous in that not only is its contact area large, but also there is an improved permeability for the reducing gas in the furnace, and consequently, the reduction efficiency is improved as mentioned hereinafter.

Figure 11:
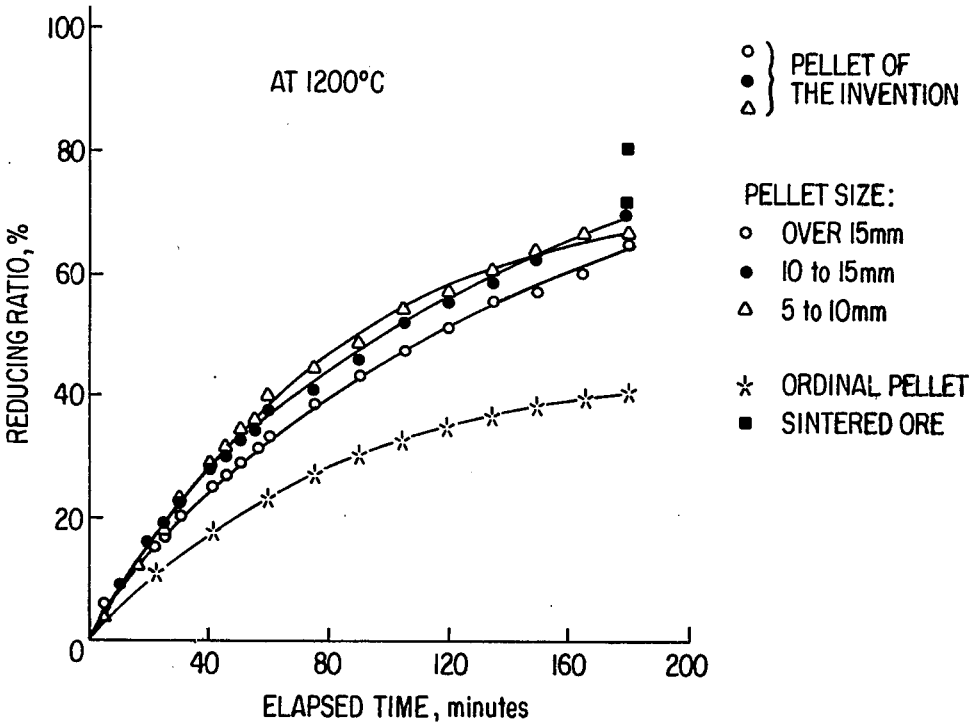
FIGS. 11 and 12 are graphs showing the relation between the reducing ratio of the pellets of the invention and conventional spherical pellets, and lapsed time.
Figure 12:
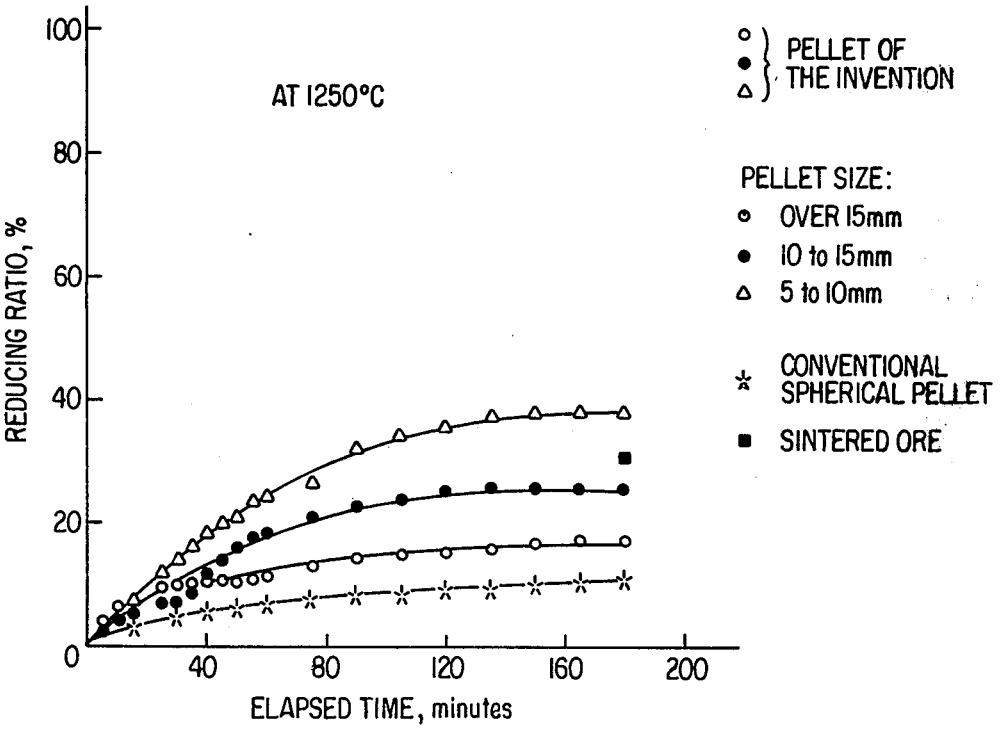

FIGS. 11 and 12 show the results of the crushed pellets having a size in excess of 15mm, 10mm, to 15mm and 5mm to 10mm, and conventional pellets in relation to the change of the reducing ratio with respect to lapsed time, in which the reducing temperature is 1200° C and 1250° C, respectively and a gas mixture of 30% CO and 70% $N_2$ is used as the reducing agent. As will be seen from these figures, the reducing reaction proceeds at a high rate and a high reducing ratio can be obtained according to the present invention.

The final reducing ratio of each pellet is shown in Table 3 and the results of the reduction test under load is shown in Table 4.

Table 3

| reducing ration(%) | crushed pellet of the present invention | | | conventional spherical pellet | sintered ore |
|---|---|---|---|---|---|
| Temperature | 5–10 mm | 10–15 mm | over 15 mm | 10–12 mm | |
| 1200° C | 65.8 | 70.3 | 67.7 | 41.2 | 70–80 |
| 1250° C | 38.0 | 24.6 | 16.8 | 11.9 | 30 |

Table 4

| | crushed pellet of the present invention | | | conventional spherical pellet |
|---|---|---|---|---|
| | 5–10 mm | 10–15 mm | over 15 mm | 10–12 mm |
| contracting ratio | 24.0 | 28.0 | 34.0 | 35.8 |
| reducing ratio | 98.1 | 94.6 | 88.8 | 88.9 |

Table 4-continued

| | crushed pellet of the present invention | | | conventional spherical pellet |
|---|---|---|---|---|
| | 5–10 mm | 10–15 mm | over 15 mm | 10–12 mm |
| swelling index | 12.9 | 12.9 | 12.7 | 12–12.5 |

Figure 13:
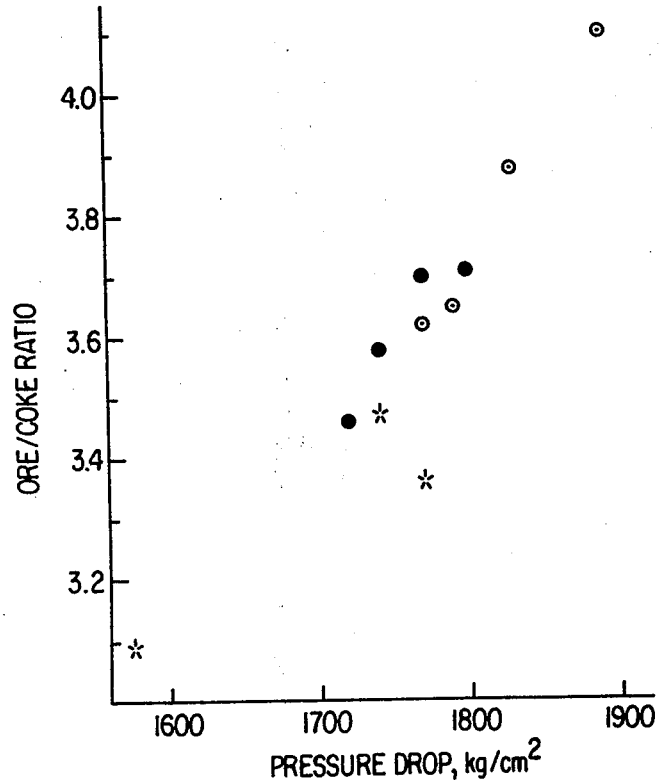
FIG. 13 is a graph showing the relation between the ore/coke ratio and the pressure drop.
Figure 14:
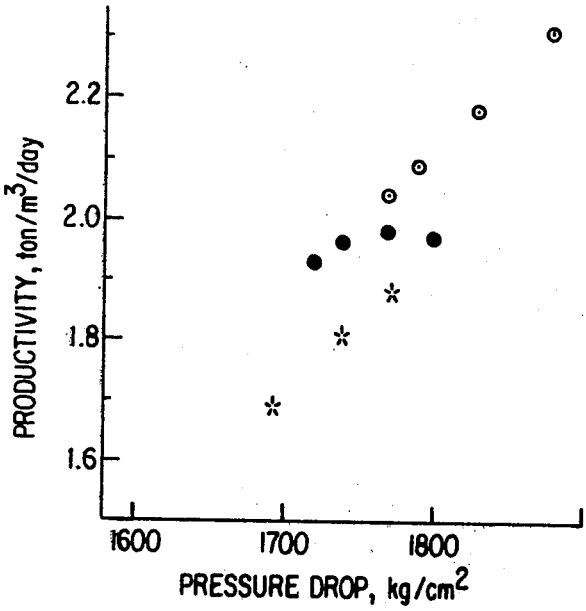
FIG. 14 is a graph which shows the relation between productivity and the pressure drop.

FIG. 13 shows the relation between the ore/coke ratio and the pressure drop caused by the load charged into the blast furnace and FIG. 14 shows the relation between the productivity (ton/m$^3$/day) and the pressure drop, wherein the charged materials consist of 50% of ore and 50% of spherical self-fluxed pellets (mark *), and 50% of spherical pellet including MgO (colored black) and 50% of crushed pellets including MgO (mark 0), respectively.

As these figures indicate, according to the present invention the ore/coke ratio can be markedly improved, as compared with conventional spherical pellets, which results in increasing the productivity.

Figure 15:
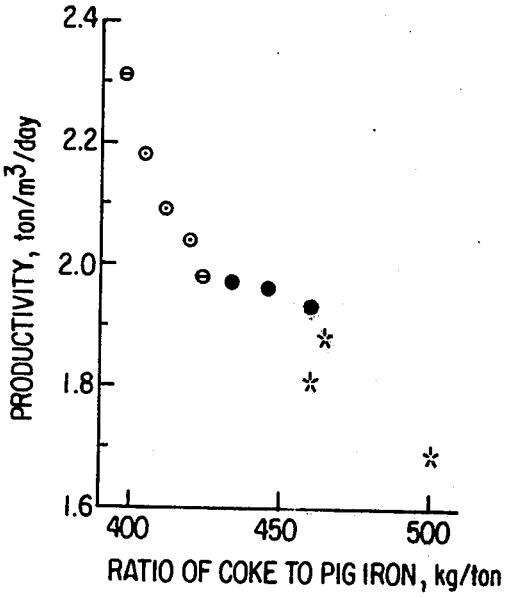
FIGS. 15 and 16 are graphs which respectively show the relation between productivity and the ratio of charged coke to produced pig iron, and the relation between productivity and the ratio of fuel consumed for the furnace operation to produced pig iron.
Figure 16:
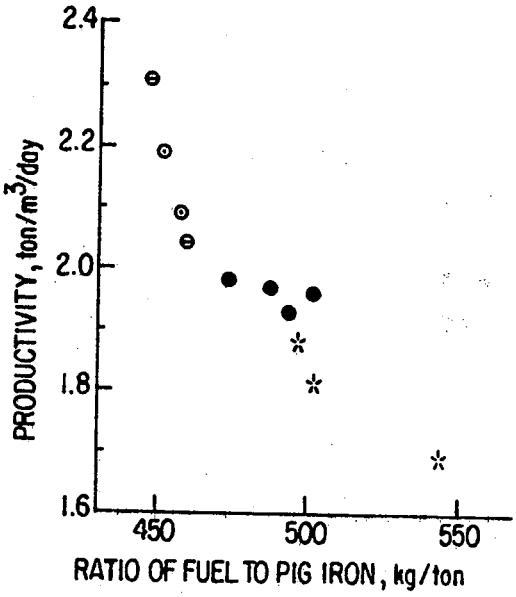

FIGS. 15 and 16 show the relation between the productivity and the ratio of coke to produced pig iron and the ratio of fuel to produced pig iron, respectively.

As can be seen from these figures, the use of the pellet of the present invention is advantageous in that, due to the above mentioned pellet properties and also to the improvement in the reduction characteristic, it is possible to remarkably increase the productivity in spite of charging the same amount of iron source (ore and pellets), that is, an extremely economical blast furnace operation can be made.

According to the present invention, as set forth above, the contact frictional resistance and the angle of the repose of pellet itself is greatly improved, and consequently the flow of the pellets toward the central part of the furnace and also a biased piling when charged into the furnace are prevented, and thus a uniform and stable pellet layer can be formed. As a result, the flow of the reducing gas becomes uniform in the radial direction within the furnace, the coke layer also becomes stabilized and the descent of materials being charged is balanced, while permeability is improved; besides, the reducing characteristics are improved due to an increased surface area, and the reaction within the furnace proceeds in an extremely efficient manner, the furnace condition is stabilized over a prolonged period and thus an ideal blast furnace operation can be established. In these points, the present invention has brought about extremely excellent effects to the technical field of this type and it is an invention having a high technical value. As concrete advantages, there is again mentioned the reduction in coke ratio and an increase in the amount of production.

Obviously, many modifications and variations of the present invention are possible in light of the above teachings. It is to be understood therefore that within the scope of the appended claims, the present invention may be practiced otherwise than as specifically described herein.

What is claimed as new and desired to be secured by Letters Patent of the United States is:

1. A fired and crushed iron ore pellet for use in the production of pig iron wherein:

the external form of said pellet comprises a combination of at least one spherically formed surface and at least one non-spherically formed surface; wherein the average particle size of said iron ore pellet is in the range of from 5 to 25 mm; and said iron ore pellet comprises iron ore and a slag component and has a compressive strength above 200 kg/pellet, a drum index about 95% above a particle size of 5 mm, and a swelling index below 14%.

2. An iron ore pellet as set forth in claim 1, wherein: said iron ore pellet further comprises 0.5% bentonite and 8 to 10% water.

3. An iron ore pellet as set forth in claim 1, wherein: said non-spherically formed surface is a planar surface.

4. An iron ore pellet as set forth in claim 1, wherein: said non-spherically formed surface is irregular and has a plurality of elevated portions and recessed portions.

5. A method of making an iron ore pellet having a specific shape to be used as the raw material in the production of pig iron, comprising the steps of:

subjecting a powdered iron ore material comprising iron ore and a slag component to granulation, drying, preheating and then firing at temperature ranges from 1150° to 1400° C or aging the same into spherical pellets so as to have a compressive strength above 200 kg/pellet, a drum index about 95% above a pellet size of 5 mm, and a swelling index below 14%, and subsequently crushing the same by crushing plates such that the average particle size of said iron ore pellet is in the range of 5 to 25 mm, with the external form of each of said pellets being composed of at least one spherical surface and at least one non-spherically formed surface; and adjusting the crushing apparatus so as to attain said average particle size.

6. An iron ore pellet made by the method of claim 5.

7. The method of claim 5, further comprising the step of:

adding 8 to 10% water to said iron ore material prior to said granulation step.

8. The method of claim 8, further comprising the step of:

adding 0.5% bentonite to said iron ore material prior to said granulation step.

9. The method as set forth in claim 5, further comprising the step of:

classifying said pellets resulting from said crushing step so as to return said spherical pellets of a size larger than said average particle size to said crushing plates while returning said spherical pellets of a size smaller than said average particle size to said granulation step.

* * * * *